US009333627B2

(12) United States Patent
Arisawa et al.

(10) Patent No.: US 9,333,627 B2
(45) Date of Patent: May 10, 2016

(54) GRINDSTONE TOOL AND METHOD FOR MANUFACTURING SAME

(75) Inventors: Hideaki Arisawa, Tokyo (JP); Toshio Kimura, Tokyo (JP)

(73) Assignee: MITSUBISHI HEAVY INDUSTRIES MACHINE TOOL CO., LTD., Ritto-Shi, Shiga (JP)

( * ) Notice: Subject to any disclaimer, the term of this patent is extended or adjusted under 35 U.S.C. 154(b) by 0 days.

(21) Appl. No.: 14/129,036

(22) PCT Filed: Feb. 24, 2012

(86) PCT No.: PCT/JP2012/054507

§ 371 (c)(1),
(2), (4) Date: Feb. 12, 2014

(87) PCT Pub. No.: WO2013/031262

PCT Pub. Date: Mar. 7, 2013

(65) Prior Publication Data

US 2014/0220872 A1 Aug. 7, 2014

(30) Foreign Application Priority Data

Sep. 2, 2011 (JP) ..... 2011-191240

(51) Int. Cl.
*B24D 5/00* (2006.01)
*B24D 18/00* (2006.01)
*B24D 3/06* (2006.01)

(52) U.S. Cl.
CPC ..... *B24D 18/0054* (2013.01); *B24D 3/06* (2013.01); *B24D 5/00* (2013.01)

(58) Field of Classification Search
CPC ..... B24D 5/00; B24D 18/00; B24D 3/06; B24D 18/0054; B24D 18/0018
USPC ..... 451/540, 541, 548, 449; 51/307, 309
See application file for complete search history.

(56) References Cited

U.S. PATENT DOCUMENTS 5,239,784 A * 8/1993 Stanfield ..... 451/548
6,200,360 B1 * 3/2001 Imai et al. ..... 51/307
2007/0178813 A1 8/2007 Raffaelli

FOREIGN PATENT DOCUMENTS

JP 62-7361 U 1/1987
JP 62-124874 A 6/1987

(Continued)

OTHER PUBLICATIONS

Japanese Office Action dated Jan. 20, 2015 issued in corresponding Japanese Application No. 2011-191240.

(Continued)

*Primary Examiner* — Robert Rose
(74) *Attorney, Agent, or Firm* — Birch, Stewart, Kolasch & Birch, LLP

(57) ABSTRACT

Provided is a grindstone tool capable of grinding with high precision and a method for manufacturing same, the grindstone tool having improved chip discharge characteristics to thereby prevent chips clogging of the chip pocket. The grinding tool comprises: dimples (14) formed in the external peripheral surface (13*a*) of a base metal (11) so that the quantity present in any position in the width direction of the external peripheral surface (13*a*) is the same in the peripheral direction; a grinding surface (21) formed by affixing a plurality of abrasive grains (22) to the external peripheral surface (13*a*) using a plating layer (23); and recess parts (24) into which chips produced by the grinding of the abrasive grains (22) are discharged, the recess parts being formed by portions that correspond to the dimples (14) in the grinding surface (21) being recessed.

1 Claim, 6 Drawing Sheets

(56) References Cited

FOREIGN PATENT DOCUMENTS

| | | | |
|---|---|---|---|
| JP | 3-55167 | A | 3/1991 |
| JP | 4-69170 | A | 3/1992 |
| JP | 6-114744 | A | 4/1994 |
| JP | 9-193022 | A | 7/1997 |
| JP | 2000-317800 | A | 11/2000 |
| JP | 2003-25230 | A | 1/2003 |

OTHER PUBLICATIONS

International Search Report and Written Opinion of the International Searching Authority with English translation.

* cited by examiner

GRINDSTONE TOOL AND METHOD FOR MANUFACTURING SAME

TECHNICAL FIELD

The present invention relates to a grindstone tool and a method for manufacturing the same, which improve the grinding performance by properly setting the surface profile of a base metal.

BACKGROUND ART

The grinding process is a process for shaping or finishing a workpiece by providing a grindstone tool with certain cutting and feeding amounts while rotating the grindstone tool at a high speed. As the grindstone tool used for such grinding process, a grindstone tool in which abrasive grains are affixed on a base metal by an electro-deposition method utilizing the principles of electroplating has generally been known.

In addition, in the above-described grindstone tool, the grinding precision (the surface roughness of the workpiece) can be improved by reducing the size of the abrasive grains. Reducing the size of the abrasive grains, however, also reduces the capacity of chip pockets formed between the abrasive grains. If the capacity of the chip pockets is reduced as described above, chips, which are produced by grinding, are easily stuck in the chip pockets, and may cause the clogging of the chip pockets.

For this reason, a grindstone tool capable of grinding with high precision by preventing chip pockets from clogging with chips has conventionally been provided. Such a conventional grindstone tool is disclosed for example in Patent Document 1.

PRIOR ART DOCUMENT

Patent Document

Patent Document 1: Japanese Patent Application Publication No. 2003-25230

SUMMARY OF THE INVENTION

Problems to be Solved by the Invention

In the conventional grindstone tool, a plurality of recesses are formed in a lattice pattern or a mesh pattern in a grinding surface. With this, chips produced by grinding are discharged into the plurality of recesses, so that the chip pockets are prevented from clogging.

Here, the conventional grindstone tool is formed in a disk shape and the grinding surface thereof is formed in a planar shape. At the time of grinding, the grindstone tool is swung in a radial direction of a workpiece while being rotated about the center axis thereof in a state where the planar grinding surface is entirely brought in contact with the surface to be ground of the workpiece. With this, although the plurality of recesses are arranged in a lattice pattern or a mesh pattern in the conventional grindstone tool, it is possible to satisfactorily obtain a desired grinding precision without particularly specifying the arrangement of these recesses.

Meanwhile, there is also a grindstone tool formed in a columnar or cylindrical shape. In the case of such a grindstone tool formed in a columnar or cylindrical shape, like a so-called grinding wheel, the grindstone tool is rotated about the center axis thereof in a state where a part of the grinding surface is brought in contact with the surface to be ground of a workpiece. For this reason, if recesses are arranged simply in a lattice pattern or a mesh pattern in the grinding surface, unevenness occurs in the movements in position of the recesses at the time of grinding. Accordingly, there is a fear that chip pockets cannot be sufficiently prevented from clogging with chips.

Therefore, the present invention has been made for solving the above-described problem and has an object to provide a grindstone tool and a method for manufacturing the same, the grindstone tool having improved chip discharge characteristic to thereby prevent chip pockets from clogging with chips and to be capable of grinding with high precision.

Means for Solving the Problems

A grindstone tool according to a first invention for solving the above-described problem is characterized in that the grindstone tool comprises: dimples formed in an external peripheral surface of a base metal such that the same number of the dimples are scattered in a circumferential direction of the external peripheral surface at any position in a width direction of the external peripheral surface; a grinding surface formed by affixing a plurality of abrasive grains on the external peripheral surface by using a plating layer; and recesses into which chips produced by grinding with the abrasive grains are to be discharged, the recesses being formed by recessing portions corresponding to the dimples in the grinding surface.

A grindstone tool according to a second invention for solving the above-described problem is characterized in that opening portions of the dimples are formed to be open to a downstream side in a grindstone rotation direction.

A method for manufacturing a grindstone tool according to a third invention for solving the above-described problem is characterized in that the method comprises: forming dimples in an external peripheral surface of a base metal such that the same number of the dimples are scattered in a circumferential direction of the external peripheral surface at any position in a width direction of the external peripheral surface; forming a grinding surface by affixing a plurality of abrasive grains on the external peripheral surface by using a plating layer; and forming recesses into which chips produced by grinding with the abrasive grains are to be discharged, by recessing portions corresponding to the dimples in the grinding surface.

Effect of the Invention

Therefore, in the grindstone tool according to the present invention, the recesses, which correspond to the dimples scattered on the external peripheral surface of the base metal, are formed in the grinding surface. The grindstone tool according to the present invention is thus capable of discharging chips produced by the grinding with the abrasive grains into the recesses, thereby improving the chip discharge characteristics. This makes it possible to prevent chip pockets between the abrasive grains from clogging with chips, and to thus perform grinding with high precision.

Moreover, in the method for manufacturing a grindstone tool according to the present invention, when the grinding surface is formed on the external peripheral surface of the base metal on which the dimples are scattered, the recesses, into which chips produced by the grinding with the abrasive grains 22 are to be discharged, can be formed by recessing the portions corresponding to the dimples in the grinding surface. This makes it possible to easily manufacture a grindstone tool excellent in grinding performance.

Figure 3A:
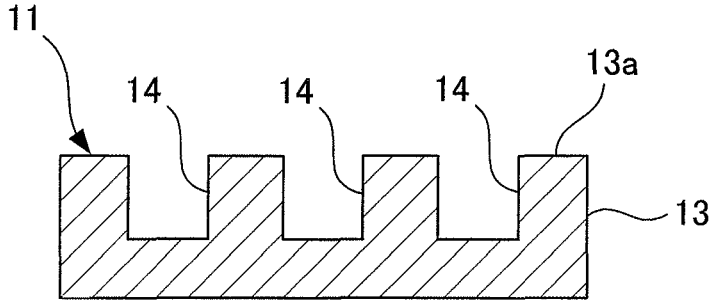
Figure 3B:
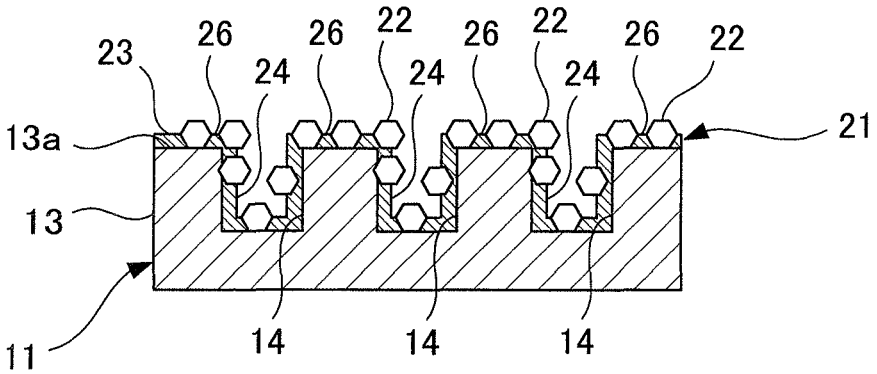

Parts (a) and (b) of FIG. 3 are cross-sectional views sequentially showing a method for manufacturing a grindstone tool according to one embodiment of the present invention.

Figure 4:
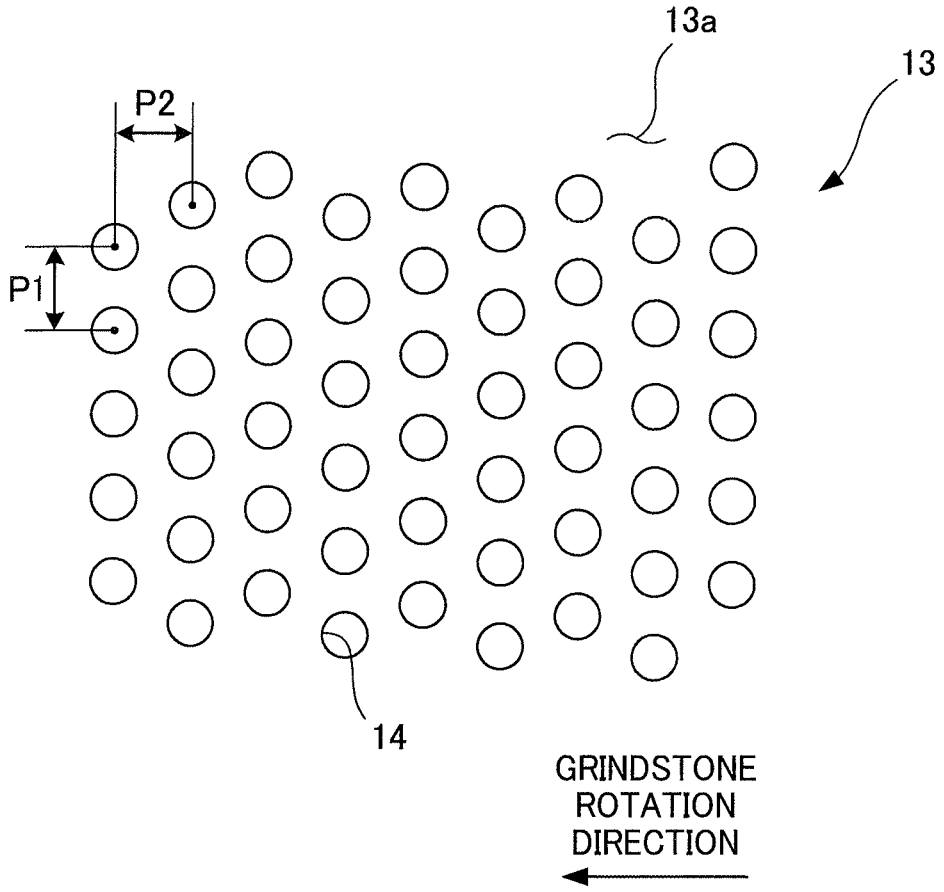

FIG. 4 is a diagram showing an arrangement of dimples formed in a base metal.

Figure 5:
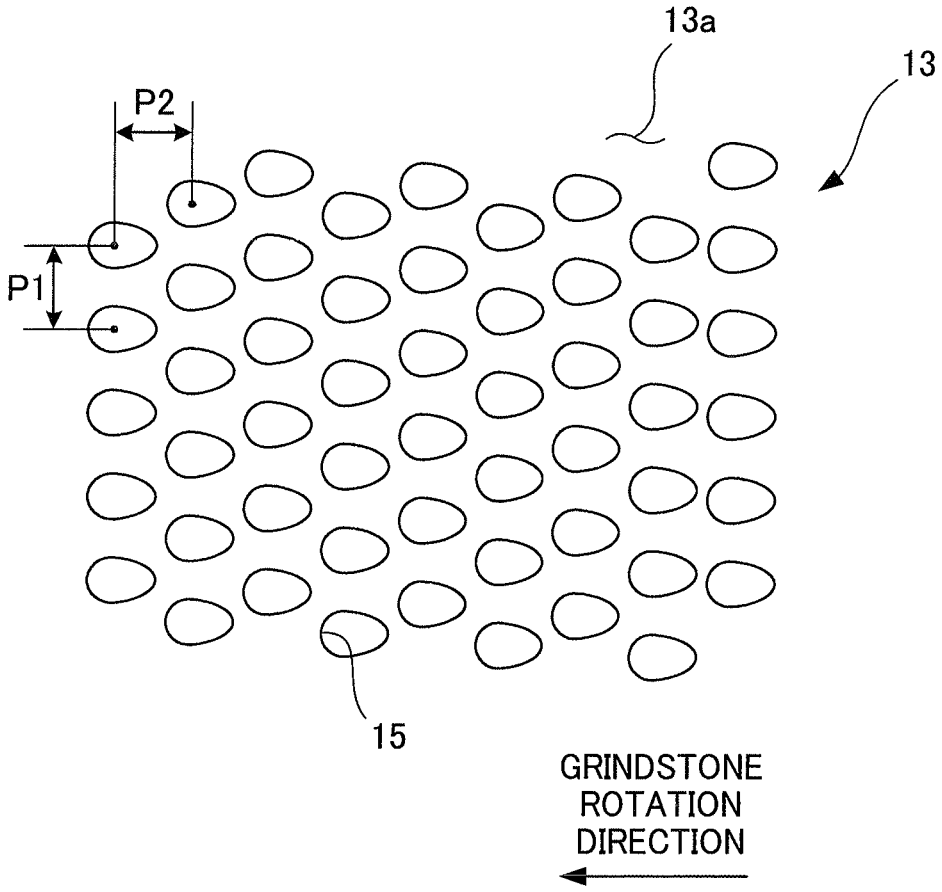

FIG. 5 is a diagram showing an arrangement of inclined dimples formed in a base metal.

Figure 6:
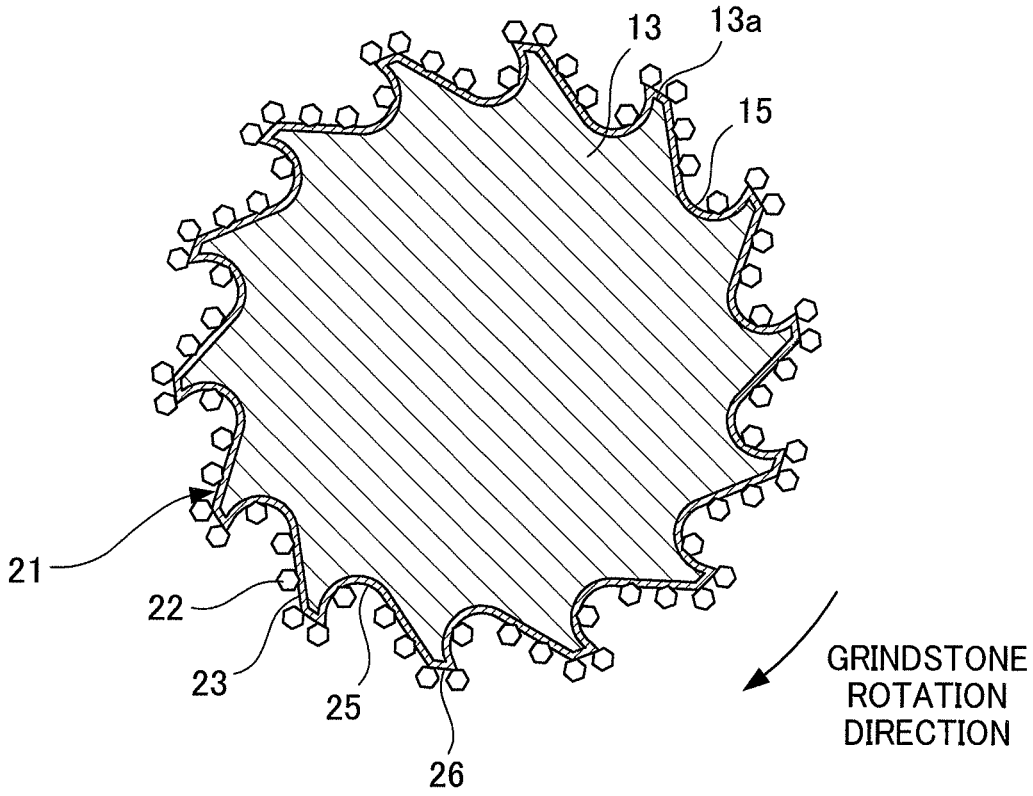

FIG. 6 is a transverse cross-sectional view of a grindstone tool having a grinding surface in which the inclined recesses are formed.

MODES FOR CARRYING OUT THE INVENTION

Hereinafter, a grindstone tool and a method for manufacturing the same according to the present invention will be described in detail by using the drawings.

Embodiments

Figure 1:
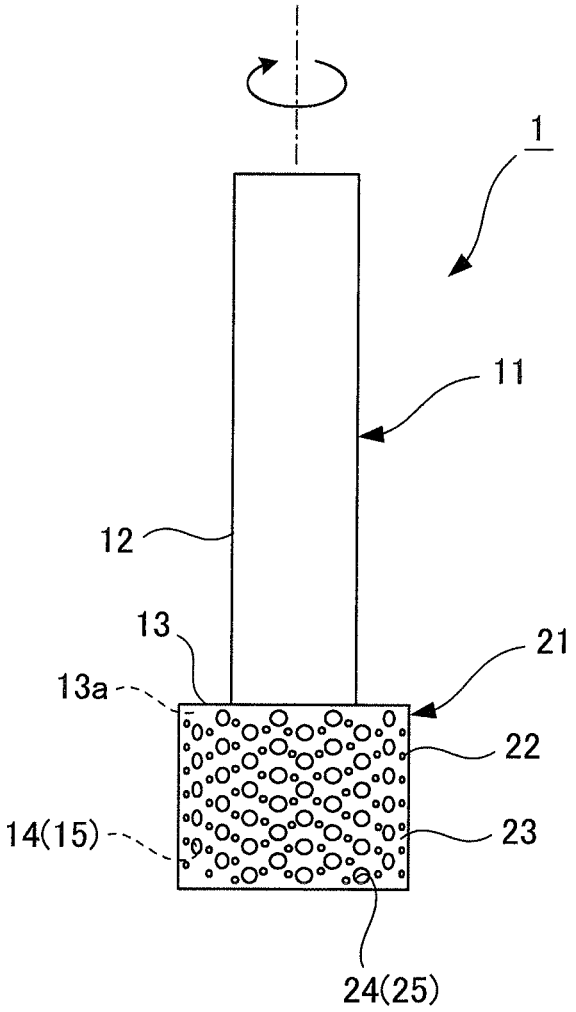
FIG. 1 is a side view of a grindstone tool according to one embodiment of the present invention.

As shown in FIG. 1, a grindstone tool 1 has a structure having a grinding surface 21 on an external peripheral portion of a columnar base metal 11. Specifically, the base metal 11 includes a small-diameter portion 12 on the base end side and a large-diameter portion 13 on the front end side. The large-diameter portion 13 has a larger diameter than that of the small-diameter portion 12. The aforementioned grinding surface 21 is formed on an external peripheral surface 13*a* of the large-diameter portion 13. The grinding surface 21 is formed such that abrasive grains 22 having a small grain size are scattered on the grinding surface 21 by an electro-deposition method utilizing the principles of electroplating.

Figure 2:
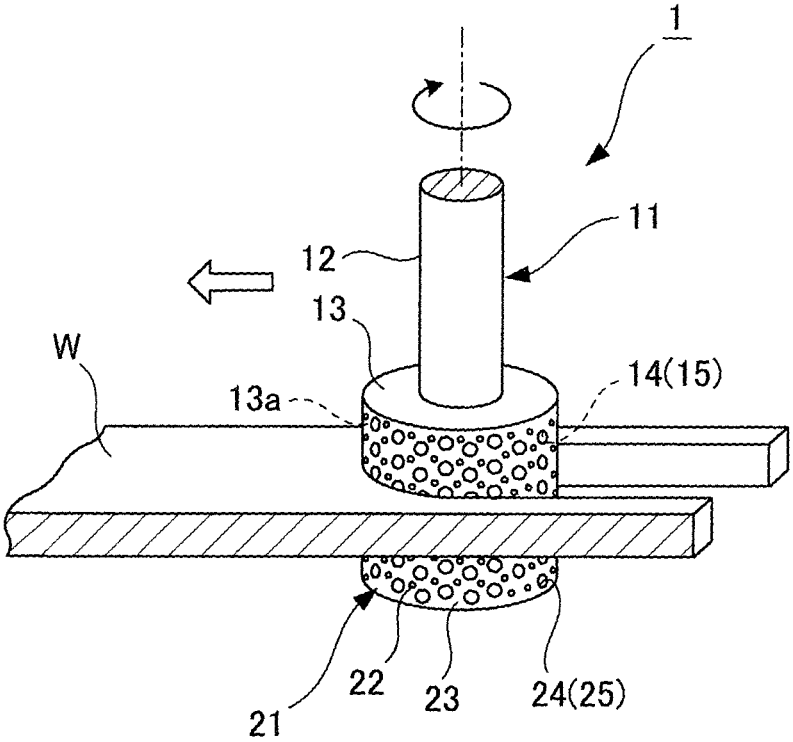
FIG. 2 is a diagram showing how a workpiece is ground by using the grindstone tool.

In addition, when a grinding process (or a trimming process) is performed, the grindstone tool 1 is fed in a direction orthogonal to the axis thereof while the grindstone tool 1 is rotated about the axis, as shown in FIG. 2. In this way, the grinding process can be performed on a workpiece W.

Next, a method for manufacturing the grindstone tool 1 will be described in detail by using FIG. 3 and FIG. 4.

First, as shown in Part (a) of FIG. 3, a plurality of dimples 14 are formed in a regular pattern in the external peripheral surface 13*a* of the base metal 11. Note that the dimples 14 are formed to extend toward the axis of the base metal 11 by a cutting process using a drill or the like, and opening portions of the dimples 14 are open outward in a radial direction of the base metal 11. In addition, the dimples 14 are dimensioned to have inner diameters sufficiently larger than the diameters of the abrasive grains 22.

Specifically, as shown in FIG. 4, the dimples 14 are formed at a predetermined pitch P1 in a width direction of the external peripheral surface 13*a* (a width direction of the grinding surface 21), and also formed at a predetermined pitch P2 in a circumferential direction of the external peripheral surface 13*a* (a circumferential direction of the grinding surface 21). Moreover, the dimples 14 are arranged at the aforementioned pitches P1 and P2 such that the dimples 14 are arranged with no gap in the entire region in the width direction of the external peripheral surface 13*a*, and such that the same number of the dimples 14 are scattered in the circumferential direction at any position in the width direction of the external peripheral surface 13*a*.

Next, as shown in Part (b) of FIG. 3, plating is performed on the external peripheral surface 13*a* of the base metal 11 to form a plating layer 23, and the abrasive grains 22 are affixed on the entire region of the external peripheral surface 13*a* including the surfaces of the dimples 14 with the plating layer 23. In this way, a grinding surface 21 is formed on the external peripheral surface 13*a* of the base metal 11.

In this process, gaps are formed between the affixed abrasive grains 22 in the grinding surface 21. The gaps form chip pockets 26, and portions corresponding to the dimples 14 of the base metal 11 are recessed relative to the other portions. The portions thus recessed form recesses 24.

Accordingly, as shown in FIG. 2, when the workpiece W is ground by using the grindstone tool 1, the surface to be ground of the workpiece W is ground with the abrasive grains 22 of the grinding surface 21. Chips produced by the grinding with the abrasive grains 22 are discharged into the chip pockets 26 and also discharged into the recesses 24.

In addition, the recesses 24 are formed in portions corresponding to the dimples 14 of the base metal 11. For this reason, the recesses 24 are not only arranged at the pitches P1 and P2 on the grinding surface 21, but also arranged such that the recesses 24 are arranged with no gap in the entire region in the width direction of the grinding surface 21, and such that the same number of the recesses 24 are scattered in the circumferential direction at any position in the width direction of the grinding surface 21. This makes it possible to cause the recesses 24 to face the surface to be ground of the workpiece W evenly in the width direction and the circumferential direction. Therefore, chips can be easily discharged into the recesses 24.

As a result, even if the grain size of the abrasive grains 22 is small and a sufficient amount of protrusion thereof cannot be secured, that is, even if the capacity of the chip pockets 26 is very small, the chip pockets 26 can be prevented from clogging with chips. Accordingly, the workpiece W can be ground with high precision by using the grindstone tool 1.

In the above-described grindstone tool 1, the dimples 14, whose opening portions are open outward in the radial direction of the base metal 11, are scattered on the base metal 11. Alternatively, as shown in FIG. 5 and FIG. 6, inclined dimples 15 whose opening portions are open to the downstream side in a rotation direction of the grindstone tool 1 may be scattered on the base metal 11.

In this way, as shown in FIG. 6, portions corresponding to the inclined dimples 15 of the base metal 11 are recessed in an oblique direction to the axis of the base metal 11 relative to the other portions in the grinding surface 21. The portions thus recessed form inclined recesses 25. Accordingly, forming the inclined recesses 25 in the grinding surface 21 makes it easier to discharge chips from the inside of the inclined recesses 25. Therefore, the chip discharge characteristics can be further improved.

Note that in the above-described embodiments, the abrasive grains 22 and the plating layer 23 are disposed also inside the recesses 24, 25; however, the abrasive grains 22 and the plating layer 23 may not necessarily disposed inside the recesses 24, 25 because the insides of the recesses 24, 25 are not involved in the grinding.

Therefore, in the grindstone tool 1 according to the present invention, the recesses 24, 25, which correspond to the dimples 14, 15 scattered on the external peripheral surface 13*a* of the base metal 11, are formed in the grinding surface

21. The grindstone tool 1 according to the present invention is thus capable of discharging chips produced by the grinding with the abrasive grains 22 into the recesses 24, 25, thereby improving the chip discharge characteristics. This makes it possible to prevent the chip pockets 26 from clogging with chips, and to thus perform grinding with high precision.

Moreover, in the method for manufacturing the grindstone tool 1 according to the present invention, when the grinding surface 21 is formed on the external peripheral surface 13*a* of the base metal 11 on which the dimples 14, 15 are scattered, the recesses 24, 25, into which chips produced by the grinding with the abrasive grains 22 are to be discharged, can be formed by recessing the portions corresponding to the dimples 14, 15 in the grinding surface 21. This makes it possible to easily manufacture the grindstone tool 1 excellent in chip discharge characteristics.

INDUSTRIAL APPLICABILITY

The present invention is applicable to a grindstone tool and a method for manufacturing the same which attempt to improve grinding performance by adjusting intervals and tip height of abrasive grains to increase the capacity of chip pockets.

The invention claimed is:

1. A grindstone tool, comprising:

dimples formed in an external peripheral surface of a base metal such that the same number of the dimples are scattered in a circumferential direction of the external peripheral surface at any position in a width direction of the external peripheral surface;

a grinding surface formed by affixing a plurality of abrasive grains on the external peripheral surface by using a plating layer; and recesses into which chips produced by grinding with the abrasive grains are to be discharged, the recesses being formed by recessing portions corresponding to the dimples in the grinding surface, wherein the dimples are inclined such that an opening portion of each dimple is located upstream of a bottom portion thereof in a rotation direction, the recesses are recessed in such a manner as to correspond to the inclination of the dimples, and the abrasive grains are also affixed to a surface of each dimple by using the plating layer so as to protrude from the surface of each dimple.

* * * * *